US005277843A

United States Patent [19]

Imai et al.

[11] Patent Number: 5,277,843

[45] Date of Patent: Jan. 11, 1994

[54] VOLTAGE NON-LINEAR RESISTOR

[75] Inventors: Osamu Imai, Kasugai; Kunio Ohira, Aichi; Ritsu Sato, Iwakura, all of Japan

[73] Assignee: NGK Insulators, Ltd., Japan

[21] Appl. No.: 826,383

[22] Filed: Jan. 27, 1992

[30] Foreign Application Priority Data

Jan. 29, 1991 [JP] Japan ..... 3-26673
Feb. 8, 1991 [JP] Japan ..... 3-37879

[51] Int. Cl.[5] ..... H01B 1/00; H01B 1/06; H01B 1/08

[52] U.S. Cl. ..... 252/518; 252/520

[58] Field of Search ..... 252/518, 520

[56] References Cited

U.S. PATENT DOCUMENTS

| | | | |
|---|---|---|---|
| 3,630,970 | 12/1971 | Nelson | 252/518 |
| 4,169,071 | 9/1979 | Eda et al. | 252/520 |
| 4,320,379 | 3/1982 | Yodogawa | 252/521 |
| 4,326,187 | 4/1982 | Miyoshi et al. | 252/518 |
| 4,450,426 | 5/1984 | Miyoshi et al. | 252/518 |
| 4,730,179 | 3/1988 | Nakata et al. | 252/518 |
| 5,062,993 | 11/1991 | Arnold, Jr. et al. | 252/518 |

FOREIGN PATENT DOCUMENTS

| | | |
|---|---|---|
| 269192 | 6/1988 | European Pat. Off. . |
| 332462 | 9/1989 | European Pat. Off. . |

OTHER PUBLICATIONS

Patent Abstracts of Japan, vol. 13, No. 481 (E-838) 31 Oct. 1989 & JP-A-1 189 901 (NGK Insulators) 31 Jul. 1989.

*Primary Examiner*—Paul Lieberman
*Assistant Examiner*—M. Kopec
*Attorney, Agent, or Firm*—Parkhurst, Wendel & Rossi

[57] ABSTRACT

A $ZnO_2$ voltage non-linear resistor excellent in all characteristics of life under electrical stress, current impulse withstandability, discharge voltage ratio, change rate of discharge voltage after application of current impulse and moisture absorbency contains, as additive ingredients: 0.4–1.5 mol. % bismuth oxides as $Bi_2O_3$, 0.3–1.5 mol. % cobalt oxides as $Co_2O_3$, 0.2–1.0 mol. % manganese oxides as $MnO_2$, 0.5–1.5 mol. % antimony oxides as $Sb_2O_3$, 0.1–1.5 mol. % chromium oxides as $Cr_2O_3$, 0.4–3.0 mol. % silicon oxides as $SiO_2$, 0.5–2.5 mol. % nickel oxides as NiO, 0.001–0.05 mol. % aluminum oxides as $Al_2O_3$, 0.0001–0.05 mol. % boron oxides as $B_2O_3$, 0.0001–0.05 mol. % silver oxides as $Ag_2O$, and 0.0005–0.1 mol. % zirconium oxides as $ZrO_2$, which bismuth oxides contain 30 wt. % of a $\gamma$-type crystalline phase. A small-sizable $ZnO_2$ voltage non-linear resistor having a higher varistor voltage in addition to the above characteristics contains, as additive ingredients: 0.3–1.5 mol. % bismuth oxides as $Bi_2O_3$, 0.3–1.5 mol. % cobalt oxides as $Co_2O_3$, 0.2–1.5 mol. % manganese oxides as $MnO_2$, 0.5–1.5 mol. % antimony oxides as $Sb_2O_3$, 0.1–1.5 mol. % chromium oxides as $Cr_2O_3$, 4.0–10.0 mol. % silicon oxides as $SiO_2$, 0.5–2.5 mol. % nickel oxides as NiO, 0.001–0.05 mol. % aluminum oxides as $Al_2O_3$, 0.0001–0.05 mol. % boron oxides as $B_2O_3$, 0.0001–0.05 mol. % silver oxides as $Ag_2O$, and 0.0005–0.1 mol % zirconium oxides as $ZrO_2$, which bismuth oxides contain 30 wt. % of a crystalline $\gamma$-type phase.

10 Claims, No Drawings

VOLTAGE NON-LINEAR RESISTOR

BACKGROUND OF THE INVENTION

1. Field of the Invention

The present invention relates to a voltage non-linear resistor comprising zinc oxide as a principal ingredient, and more particularly to a voltage non-linear resistor which is excellent in life expectancy under electrical stress, current impulse withstand capability, discharge voltage ratio, change rate of discharge voltage after applying current impulse and water penetrating characteristics.

2. Description of the Prior Art

Heretofore, there have been widely known resistors comprising zinc oxide as a principal ingredient and small amounts of additives, which exhibit an excellent voltage non-linear characteristic. Utilizing such a characteristic, these resistors have been used in, for example, lightning arresters and the like.

In particular, when they are used as a lightning arrester, even if an excessive current flows by a lightning strike, the current is grounded by the voltage non-linear resistor which is usually an insulator and turns to a conductor when a voltage exceeds a preestimated level. Thus, accidents due to lightning strikes can be prevented.

There have hitherto been disclosed Bi, Co, Mn, Sb, Cr, Si, Ni, Al, B, Ag and Zr as an applicable additive, for example, in Japanese Patent Application Publication No. 59-41,285 and Japanese Patent Laid-open Application Nos. 62-237,703, 63-136,603 and 1-228,105.

Meanwhile, many have expected the develop of a voltage non-linear resistor that is excellent in all electrical characteristics to be provided by voltage non-linear resistors, such as long life under electrical stress, current impulse withstand capability, discharge voltage ratio, change rate of discharge voltage after applying current impulse and water penetrating characteristics. Although each characteristic is good according to the techniques disclosed in the each of the above patent applications, difficulties have been encountered in satisfying all the above 5 particulars.

Resistors are required to have a long life under electrical stress to be stabilized for a long period of time without thermal runaway, being induced by an applied voltage. Namely, with respect to the life under electrical and thermal stresses converted from an Arrhenius' plot, the resistors are desired to have a good performance for at least 50 years, preferably at least 100 years under a voltage applying rate of 85% at 40° C.

Further, the resistors are required to have a current impulse withstand capability high enough to withstand fracture due to current impulse. Namely, a lightning current impulse withstand capability which is determined as an energy value (passed value) converted from a withstand capability after 2 repetitions, with a 5 minute interval, of applying lightning current impulse with a waveform of 4/10 μs is desired to be at least 16 KJ. The switching current impulse withstand capability which is determined as an energy value (passed value) converted from a withstand capability after 20 repetitions of applying switching current impulse with a waveform of 2 ms is desired to be at least 16 KJ.

On the other hand, the discharge voltage increases with decreasing voltage non-linearity, in a large current region. Accordingly, it is required that the voltage non-linearity is high, namely, the discharge voltage is low, even in the large current region. Namely, the discharge voltage ratio which is defined as a ratio of a varistor voltage (discharge voltage at a 1 A current: hereinafter referred to as "$V_{1A}$") to a discharge voltage, for example, at a 40 KA current ($V_{40KA}$) is desired to be less than 2.0.

Further, the resistors are required to have voltage-current characteristics hardly deteriorated due to current impulse, i.e., a low change rate of discharge voltage after applying current impulse. For example, change rate of varistor voltage ($\Delta V_{1A}$) before and after 10 repetitions of applying current impulse of 40 KA with a waveform of 4/10 μs is desired to be within 5%.

Furthermore, as for water penetrability, there is seen a phenomenon such that water permeates through micro-cracks or the like into a resistor. The water penetrability is evaluated by a fluorescent flaw detective test described hereinafter. With regard to a water penetrative resistor, deterioration of characteristics of the resistor is not recognized under dry conditions. However, the life under electrical stress and the current impulse withstand capability deteriorate under moisturized conditions. Therefore, water penetrating characteristics are important in respect of a long-term reliability. Particularly, the water penetrating characteristics are important to resistors to be applied to lightning arresters or the like to be used outdoors.

Thus, voltage nonlinear resistors to be used as a lightning arrester or the like are required to satisfy simultaneously the above-described 5 characteristics. Particularly, in order to make a resistor compact (by decreasing its length), the varistor voltage of the resistor should be increased while the discharge voltage ratio is kept low. Namely, in the case of a small-sized lightning arrester designed as a resistor having a high varistor voltage ($V_{1mA} \leqq 300$ V/mm), the above-described lightning current impulse withstand capability is desirably at least 13 KJ and the switching current impulse withstand capability is desirably at least 11 KJ. Further, the discharge voltage ratio which is defined as a ratio of a varistor voltage at a 1 mA current ($V_{1mA}$) to a discharge voltage, for example, at a 30 KA current ($V_{30KA}$) is desired to be less than 2.2. Furthermore, the change rate of varistor voltage ($\Delta V_{1mA}$) before and after 10 repetitions of applying current impulse of 40 KA with a waveform of 4/10 μs is desired to be within 10%. However, resistors having a high varistor voltage such as $V_{1mA} \leqq 300$ V/mm which can satisfy all the above 5 particulars have not yet been obtained.

SUMMARY OF THE INVENTION

The object of the present invention is to eliminate the above-described difficulties and to provide voltage non-linear resistors with excellent characteristics, such as long life under electrical stress, current impulse withstand capability, discharge voltage ratio, change rate of discharge voltage after application of current impulse and water penetrating characteristics.

Another object of the present invention is to provide small-sized, compact lightning arresters excellent in such characteristics as above.

The voltage non-linear resistor according to a first embodiment of the present invention comprises zinc oxide as a principal ingredient and 0.4–1.5 mol. % of bismuth oxides calculated as $Bi_2O_3$, 0.3–1.5 mol. % of cobalt oxides calculated as $Co_2O_3$, 0.2–1.0 mol. % of manganese oxides calculated as $MnO_2$,
0.5–1.5 mol. % of antimony oxides calculated as $Sb_2O_3$,
0.1–1.5 mol. % of chromium oxides calculated as $Cr_2O_3$,
0.4–3.0 mol. % of silicon oxides calculated as $SiO_2$,
0.5–2.5 mol. % of nickel oxides calculated as NiO,
0.001–0.05 mol. % of aluminum oxides calculated as $Al_2O_3$,
0.0001–0.05 mol. % of boron oxides calculated as $B_2O_3$,
0.0001–0.05 mol. % of silver oxides calculated as $Ag_2O$, and
0.0005–0.1 mol. % of zirconium oxides calculated as $ZrO_2$,
as additives, said bismuth oxides comprising a crystalline phase containing a γ-type crystalline phase in an amount of at least 30% by weight of said bismuth oxides.

Alternatively, the voltage non-linear resistor according to a second embodiment of the present invention comprises zinc oxide as a principal ingredient and
0.3–1.5 mol. % of bismuth oxides calculated as $Bi_2O_3$,
0.3–1.5 mol. % of cobalt oxides calculated as $Co_2O_3$,
0.2–1.5 mol. % of manganese oxides calculated as $MnO_2$,
0.5–1.5 mol. % of antimony oxides calculated as $Sb_2O_3$,
0.1–1.5 mol. % of chromium oxides calculated as $Cr_2O_3$,
4.0–10.0 mol. % of silicon oxides calculated as $SiO_2$,
0.5–2.5 mol. % of nickel oxides calculated as NiO,
0.001–0.05 mol. % of aluminum oxides calculated as $Al_2O_3$,
0.0001–0.05 mol. % of boron oxides calculated as $B_2O_3$,
0.0001–0.05 mol. % of silver oxides calculated as $Ag_2O$, and
0.0005–0.1 mol. % of zirconium oxides calculated as $ZrO_2$,
as additives, said bismuth oxides comprising a crystalline phase containing a γ-type crystalline phase in an amount of at least 30% by weight of said bismuth oxides.

DETAILED DESCRIPTION OF THE INVENTION

In the first embodiment of the invention, preferable contents of the additives are:
0.6–1.2 mol. % of bismuth oxides calculated as $Bi_2O_3$,
0.5–1.2 mol. % of cobalt oxides calculated as $Co_2O_3$,
0.3–0.7 mol. % of manganese oxides calculated as $MnO_2$,
0.8–1.3 mol. % of antimony oxides calculated as $Sb_2O_3$,
0.3–1.0 mol. % of chromium oxides calculated as $Cr_2O_3$,
0.6–1.9 mol. % of silicon oxides calculated as $SiO_2$,
1.0–1.5 mol. % of nickel oxides calculated as NiO,
0.002–0.03 mol. % of aluminum oxides calculated as $Al_2O_3$,
0.001–0.03 mol. % of boron oxides calculated as $B_2O_3$,
0.001–0.03 mol. % of silver oxides calculated as $Ag_2O$, and
0.001–0.05 mol. % of zirconium oxides calculated as $ZrO_2$,
and, further, a preferable content of the γ-type crystalline phase in the crystalline phase of the bismuth oxides is at least 50% by weight of said bismuth oxides.

According to the first embodiment of the invention, voltage non-linear resistors excellent in all respects of the life under electrical stress, current impulse withstand capability, discharge voltage ratio, change rate of discharge voltage after applying current impulse and water penetrating characteristics can be first obtained by a synergistic effect between the above-defined composition of the additive ingredients and the γ-phase contained in an amount of at least 30% by weight, preferably at least 50% by weight, of the bismuth oxide crystalline phase in the resistor.

Alternatively, the voltage non-linear resistor according to the second embodiment of the present invention is suitable particularly as small-sized lightning arresters or the like having a high varistor voltage which is designed to satisfy such a relation as $V_{1mA} \leqq 300$ V/mm in order to achieve compaction (shortening) of the resistor.

In the second embodiment of the invention, preferable contents of the additives are:
0.5–1.0 mol. % of bismuth oxides calculated as $Bi_2O_3$,
0.5–1.2 mol. % of cobalt oxides calculated as $Co_2O_3$,
0.3–1.0 mol. % of manganese oxides calculated as $MnO_2$,
0.8–1.3 mol. % of antimony oxides calculated as $Sb_2O_3$,
0.3–1.0 mol. % of chromium oxides calculated as $Cr_2O_3$,
6.0–9.0 mol. % of silicon oxides calculated as $SiO_2$,
1.0–1.5 mol. % of nickel oxides calculated as NiO,
0.002–0.02 mol. % of aluminum oxides calculated as $Al_2O_3$,
0.001–0.03 mol. % of boron oxides calculated as $B_2O_3$,
0.001–0.03 mol. % of silver oxides calculated as $Ag_2O$, and
0.001–0.05 mol. % of zirconium oxides calculated as $ZrO_2$,
and, further, a preferable content of the γ-type crystalline phase in the crystalline phase of the bismuth oxides is at least 50% by weight of said bismuth oxides.

According to the second embodiment of the invention, voltage non-linear resistors suitable as small-sized lightning arresters or the like having a high varistor voltage and being excellent in all respects of the life under electrical stress, current impulse withstand capability, discharge voltage ratio, change rate of discharge voltage after application of current impulse and water penetrating characteristics can be first obtained by a synergistic effect between the above-defined composition of the additive ingredients and the γ-phase contained in an amount of at least 30% by weight, preferably at least 50% by weight, of the bismuth oxide crystalline phase in the resistor.

Among the above-described additives, an amorphous silicon oxide is preferably used as the silicon oxides. In the various additives, the silicon oxides react with zinc oxides and produce zinc silicate ($Zn_2SiO_4$) in the resistor. This zinc silicate takes part in uniformity of resistor, such as grain-growth control or the like, the zinc oxides in the resistor. Accordingly, in the case where the silicon oxides are crystalline, since the reactivity thereof with the zinc oxides decreases, a particle size distribution of the zinc oxides in the resistor becomes broad and the uniformity of the resistor lowers. Therefore, variation of the switching current impulse withstand capability or the like increases. It is preferred to use an amorphous silicon oxide in the above additive composition, because the particle size distribution of the zinc oxides in a resistor becomes very sharp and 75% or more of the particles fall within the range between ½ to 2 times of the average particle diameter. Further, as a method for incorporating the zirconium oxides, it is preferred to incorporate (i) as an aqueous solution of zirconium nitrate, zirconyl nitrate or the like, or (ii) by means of abrasion of zirconia pebbles (zirconia partially stabilized by Y, Ca, Mg or the like). Furthermore, in order to increase the γ-phase content in the bismuth oxide crystalline phase in the resistor to at least 30% by weight, preferably at least 50% by weight, it is preferred to subject a fired body to a heat treatment at 450°-900° C., preferably 600°-750° C.

As it is clear from the examples hereinafter described, the amount of each additive ingredient to be added according to the first embodiment of the present invention should be limited from the following reasons:

If the bismuth oxides are less than 0.4 mol. % calculated as $Bi_2O_3$, the life under electrical stress and the both lightning and switching current impulse withstand capabilities deteriorate, while if they exceed 1.5 mol. %, the both current impulse withstand capabilities, discharge voltage ratio and water penetrating characteristics deteriorate. Therefore, the bismuth oxide content is limited to 0.4–1.5 mol. %.

If the cobalt oxides are less than 0.3 mol. % calculated as $Co_2O_3$, the discharge voltage ratio and change rate of discharge voltage after applying current impulse (hereinafter referred to as "CHANGE RATE") deteriorate, while if they exceed 1.5 mol. %, the discharge voltage ratio and CHANGE RATE also deteriorate. Therefore, the cobalt oxide content is limited to 0.3–1.5 mol. %.

If the manganese oxides are less than 0.2 mol. % calculated as $MnO_2$, the life under electrical stress deteriorates, while if they exceed 1.0 mol. %, the life under electrical stress also deteriorates. Therefore the manganese oxide content is limited to 0.2–1.0 mol. %.

If the antimony oxides are less than 0.5 mol. % calculated as $Sb_2O_3$, the lightning current impulse withstand capability and CHANGE RATE deteriorate, while if they exceed 1.5 mol. %, both the lightning and switching current impulse withstand capabilities, discharge voltage ratio and CHANGE RATE deteriorate. Therefore, the antimony oxide content is limited to 0.5–1.5 mol. %.

If the chromium oxides are less than 0.1 mol. % calculated as $Cr_2O_3$, the life under electrical stress and CHANGE RATE deteriorate, while if they exceed 1.5 mol. %, the life under electrical stress and water penetrating characteristics deteriorate. Therefore, the chromium oxide content is limited to 0.1–1.5 mol. %.

If the silicon oxides are less than 0.4 mol. % calculated as $SiO_2$, the life under electrical stress, discharge voltage ratio and CHANGE RATE deteriorate, while if they exceed 3.0 mol. %, the life under electrical stress, discharge voltage ratio, CHANGE RATE and water penetrating characteristics deteriorate as well. Therefore, the silicon oxide content is limited to 0.4–3.0 mol. %.

If the nickel oxides are less than 0.5 mol. % calculated as NiO, the CHANGE RATE deteriorates, while if they exceed 2.5 mol. %, the switching current impulse withstand capability, discharge voltage ratio and CHANGE RATE deteriorate. Therefore, the nickel oxide content is limited to 0.5–2.5 mol. %.

If the aluminum oxides are less than 0.001 mol. % calculated as $Al_2O_3$, the lightning current impulse withstand capability and discharge voltage ratio deteriorate, while if they exceed 0.05 mol. %, the life under electric stress and CHANGE RATE deteriorate. Therefore, the aluminum oxide content is limited to 0.001–0.05 mol. %.

If the boron oxides are less than 0.0001 mol. % calculated as $B_2O_3$, the life under electrical stress, CHANGE RATE and water penetrating characteristics deteriorate, while if they exceed 0.05 mol. %, the discharge voltage ratio and CHANGE RATE deteriorate. Therefore, the boron oxide content is limited to 0.0001–0.05 mol. %.

If the silver oxides are less than 0.0001 mol. % calculated as $Ag_2O$, the life under electrical stress, lightning current impulse withstand capability and CHANGE RATE deteriorate, while if they exceed 0.05 mol. %, the life under electrical stress and CHANGE RATE deteriorate. Therefore, the silver oxide content is limited to 0.0001–0.05 mol. %.

If the zirconium oxides are less than 0.0005 mol. % calculated as $ZrO_2$, the lightning current impulse withstand capability, discharge voltage ratio and water penetrating characteristics deteriorate, while if they exceed 0.1 mol. %, the life under electrical stress, lightning current impulse withstand capability, discharge voltage ratio and CHANGE RATE deteriorate. Therefore, the zirconium oxide content is limited to 0.0005–0.1 mol. %.

In the meanwhile, an effect of the zirconium oxides added is remarkably exhibited when the γ-phase is present in an amount of at least 30% by weight of the bismuth oxide in the resistor. In addition, it is indispensable that the γ-type crystalline phase is present in an amount of at least 30% by weight of the bismuth oxide crystalline phase, for the life under electrical stress, both lightning and switching current impulse withstand capabilities and CHANGE RATE are improved with increasing amount of the γ-phase. Furthermore, other than the above-described additives, it is preferred to add sodium oxide in an amount of 0.001–0.05 mol. %, preferably 0.005–0.02 mol. %, calculated as $Na_2O$ to improve the CHANGE RATE and water penetrating characteristics. Alternatively, in respect of the life under electrical stress, the resistor is preferred to contain iron oxides in an amount of not exceeding 0.05% by weight calculated as $Fe_2O_3$.

Alternatively, the amount of each additive ingredient to be added according to the second embodiment of the present invention should be limited from the following reasons:

If the bismuth oxides are less than 0.3 mol % calculated as $Bi_2O_3$, the life under electrical stress and both the lightning and switching current impulse withstand capabilities deteriorate, while if they exceed 1.5 mol. %, both the current impulse withstand capabilities, discharge voltage ratio and water penetrating characteristics deteriorate. Therefore, the bismuth oxide content is limited to 0.3–1.5 mol. %.

If the cobalt oxides are less than 0.3 mol. % calculated as $Co_2O_3$, the discharge voltage ratio and CHANGE RATE deteriorate, while if they exceed 1.5 mol. %, the discharge voltage ratio and CHANGE RATE also deteriorate. Therefore, the cobalt oxide content is limited to 0.3–1.5 mol. %.

If the manganese oxides are less than 0.2 mol. % calculated as $MnO_2$, the life under electrical stress deteriorates, while if they exceed 1.5 mol. %, the life under electrical stress also deteriorates. Therefore the manganese oxide content is limited to 0.2–1.5 mol. %.

If the antimony oxides are less than 0.5 mol. % calculated as $Sb_2O_3$, the lightning current impulse withstand capability and CHANGE RATE deteriorate, while if they exceed 1.5 mol. %, the both lightning and switching current impulse withstand capabilities, discharge voltage ratio and CHANGE RATE deteriorate. Therefore, the antimony oxide content is limited to 0.5–1.5 mol. %.

If the chromium oxides are less than 0.1 mol. % calculated as $Cr_2O_3$, the life under electrical stress and CHANGE RATE deteriorate, while if they exceed 1.5 mol. %, the life under electrical stress and water penetrating characteristics deteriorate. Therefore, the chromium oxide content is limited to 0.1–1.5 mol. %.

If the silicon oxides are less than 4.0 mol. % calculated as $SiO_2$, the life under electrical stress, lightning current impulse withstand capability, discharge voltage ratio and CHANGE RATE deteriorate, while if they exceed 10.0 mol. %, the life under electrical stress, the both lightning and switching current impulse withstand capabilities, discharge voltage ratio, CHANGE RATE and water penetrating characteristics deteriorate as well. Therefore, the silicon oxide content is limited to 4.0–10.0 mol. %.

If the nickel oxides are less than 0.5 mol. % calculated as NiO, the CHANGE RATE deteriorates, while if they exceed 2.5 mol. %, the switching current impulse withstand capability, discharge voltage ratio and CHANGE RATE deteriorate. Therefore, the nickel oxide content is limited to 0.5–2.5 mol. %.

If the aluminum oxides are less than 0.001 mol. % calculated as $Al_2O_3$, the lightning current impulse withstand capability and discharge voltage ratio deteriorate, while if they exceed 0.05 mol. %, the life under electric stress and CHANGE RATE deteriorate. Therefore, the aluminum oxide content is limited to 0.001–0.05 mol. %.

If the boron oxides are less than 0.0001 mol. % calculated as $B_2O_3$, the life under electrical stress, CHANGE RATE and water penetrating characteristics deteriorate, while if they exceed 0.05 mol. %, the discharge voltage ratio and CHANGE RATE deteriorate. Therefore, the boron oxide content is limited to 0.0001–0.05 mol. %.

If the silver oxides are less than 0.0001 mol. % calculated as $Ag_2O$, the life under electrical stress, lightning current impulse withstand capability and CHANGE RATE deteriorate, while if they exceed 0.05 mol. %, the life under electrical stress and CHANGE RATE deteriorate. Therefore, the silver oxide content is limited to 0.0001–0.05 mol. %.

If the zirconium oxides are less than 0.0005 mol. % calculated as $ZrO_2$, the lightning current impulse withstand capability, discharge voltage ratio and water penetrating characteristics deteriorate, while if they exceed 0.1 mol. %, the life under electrical stress, lightning current impulse withstand capability, discharge voltage ratio and CHANGE RATE deteriorate. Therefore, the zirconium oxide content is limited to 0.0005–0.1 mol. %.

In the meanwhile, an effect of the zirconium oxides added is remarkably exhibited when the $\gamma$-phase is present in an amount of at least 30% by weight of the bismuth oxide in the resistor. In addition, it is indispensable that the $\gamma$-type crystalline phase is present in an amount of at least 30% by weight of the bismuth oxide crystalline phase, for the life under electrical stress, both lightning and switching current impulse withstand capabilities and CHANGE RATE are improved with increasing amount of the $\gamma$-phase. Furthermore, other than the above-described additives, it is preferred to add sodium oxide in an amount of 0.001–0.05 mol. %, preferably 0.005–0.02 mol. %, calculated as $Na_2O$ to improve the CHANGE RATE and water penetrating characteristics. Alternatively, in respect of the life under electrical stress, the resistor is preferred to contain iron oxides in an amount of not exceeding 0.05% by weight calculated as $Fe_2O_3$. Additionally, the resistor is preferred to have a varistor voltage ($V_{1mA}$) of 300–550 V/mm, more preferably 350–500 V/mm.

For obtaining voltage non-linear resistors comprising zinc oxides as a principal ingredient, in the outset, a zinc oxide starting material which has been adjusted into a predetermined grain size is admixed with predetermined amounts of additives comprising bismuth oxides, cobalt oxides (preferably in the form of $Co_3O_4$), manganese oxides, antimony oxides, chromium oxides, silicon oxides (preferably amorphous), nickel oxides, aluminum oxides, boron oxides, silver oxides and zirconium oxide, which have been adjusted into a predetermined grain size. In this case, silver nitrate and boric acid may be used in lieu of silver oxides and boron oxide, respectively. Besides, a bismuth borosilicate glass containing silver may be preferably used. Further, the additives provisionally fired at 600°–1,000° C., then pulverized and adjusted into a predetermined grain size may be mixed with the zinc oxide starting material. In this case, these starting powders are admixed with a predetermined amount of a binder, preferably a polyvinylalcohol aqueous solution, a dispersant or the like. The aluminum oxides and zirconium oxides are added preferably in the form of an aluminum nitrate solution or zirconium nitrate solution. Additionally, the aluminum oxides may also be incorporated by means of abrasion of zirconia pebbles.

Then, vacuum deaeration is conducted at a vacuum degree of preferably not exceeding 200 mmHg, to yield a mixed slip preferably having a water content of about 30–35% by weight and a viscosity of 100±50 cp. Then, the obtained mixed slip is fed into a spray drying apparatus to granulate into granules having an average particle diameter of 50–150 $\mu$m, preferably 80–120 $\mu$m, and a water content of 0.5–2.0%, preferably 0.9–1.5%, by weight. The obtained granules are formed into a predetermined shape under a shaping pressure of 400–1,000 kg/cm$^2$ at a shaping step.

Then, heating the shaped body at 400°–700° C. under conditions of heating and cooling rates of 10°–100° C./hr. to remove organic substances, a dewaxed body is obtained. The dewaxed body is then fired under conditions of heating and cooling rates of 30°–70° C./hr. with a retention time of 1–5 hours at 800°–1,000° C., to obtain a provisionally fired body. Then, a highly resistive side layer is formed on the side surface of the provisionally fired body. In this embodiment, a mixed slip for the resistive layer comprising predetermined amounts of bismuth oxides, antimony oxides, zinc oxides, silicon oxides and the like admixed with ethyl cellulose, butyl carbitol, n-butyl acetate or the like as an organic binder is applied to form a layer 30–300 $\mu$m thick on the side surface of the provisionally fired body. Then, the composite body is fired under conditions of heating and cooling rates of 20°–100° C./hr. with a hold time of 3–7 hours, at 1,000°–1,300° C., preferably 1,050°–1,250° C. Then, it is further heat-treated in air at 450°–900° C. (preferably 600°–750° C.) for more than 1 hour, at heating and cooling rates of preferably not exceeding 200° C./hr.

Additionally, formation of a glass layer can be simultaneously conducted by applying a glass paste comprising glass powder admixed with ethyl cellulose, butyl carbitol, n-butyl acetate or the like as an organic binder, with a thickness of 50–300 μm onto the above high-insulating layer on the above-mentioned side surface and then heat-treated in air under conditions of heating and cooling rates of not exceeding 200° C./hr. with a hold time of 1 hour or more at 450°–900° C. By adequately selecting the above-described composition for the resistor and conducting this heat treatment, the γ-phase content is made to be at least 30% by weight of the bismuth oxide phase in the resistor.

Then, the both end surfaces of the obtained voltage non-linear resistor are polished with an abrasive, such as a diamond grindstone. Then, after cleaning the polished surfaces, the both polished surfaces are provided with electrodes, such as aluminum or the like, by means of, for example, metallizing. Thus, a voltage non-linear resistor is obtained.

Meanwhile, resistors according to the first embodiment of the present invention are preferred to have a varistor voltage ($V_{1A}$) of 200–350 V/mm. On the other hand, resistors according to the second embodiment of the invention are preferred to have a varistor voltage ($V_{1mA}$) of at least 300 V/mm.

With respect to voltage non-linear resistors respectively inside and outside the scope of the invention, the results of measurement on various characteristics will be explained hereinafter.

EXAMPLE 1

Using the additive elements inside or outside the scope of the present invention shown in Table 1, voltage non-linear resistors having a diameter of 47 mm and a thickness of 22.5 mm were prepared. The γ-$Bi_2O_3$ phase content, life under electrical stress, lightning current impulse withstand capability, switching current impulse withstand capability, discharge voltage ratio, change rate of discharge voltage after applying current impulse and water penetrating characteristics in each resistor, were determined. Each resistor had a $V_{1A}$ within the range of 200–350 V/mm. As the silicon oxides, an amorphous silica was used and as the zirconium oxides, zirconium nitrate was used. Further, as the cobalt oxides, that in the form of $Co_3O_4$ was used. As the silver oxides and the boron oxides, a bismuth borosilicate glass containing silver was used. The heat treatment was conducted at 450°–900° C. The results are shown in Table 1.

TABLE 1(a)

| Run No. | Additive element | | | | | | | | | | |
|---|---|---|---|---|---|---|---|---|---|---|---|
| Example | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 1 | 0.4 | 1.0 | 0.5 | 1.0 | 1.0 | 1.0 | 1.2 | 0.005 | 0.005 | 0.01 | 0.005 |
| 2 | 0.6 | 1.0 | 0.5 | 1.0 | 1.0 | 1.0 | 1.2 | 0.005 | 0.005 | 0.01 | 0.005 |
| 3 | 0.9 | 1.0 | 0.5 | 1.0 | 1.0 | 1.0 | 1.2 | 0.005 | 0.005 | 0.01 | 0.005 |
| 4 | 1.2 | 1.0 | 0.5 | 1.0 | 1.0 | 1.0 | 1.2 | 0.005 | 0.005 | 0.01 | 0.005 |
| 5 | 1.5 | 1.0 | 0.5 | 1.0 | 1.0 | 1.0 | 1.2 | 0.005 | 0.005 | 0.01 | 0.005 |
| 6 | 0.9 | 0.3 | 0.5 | 1.0 | 1.0 | 1.0 | 1.2 | 0.005 | 0.005 | 0.01 | 0.005 |
| 7 | 0.9 | 0.5 | 0.5 | 1.0 | 1.0 | 1.0 | 1.2 | 0.005 | 0.005 | 0.01 | 0.005 |
| 8 | 0.9 | 1.2 | 0.5 | 1.0 | 1.0 | 1.0 | 1.2 | 0.005 | 0.005 | 0.01 | 0.005 |
| 9 | 0.9 | 1.5 | 0.5 | 1.0 | 1.0 | 1.0 | 1.2 | 0.005 | 0.005 | 0.01 | 0.005 |
| 10 | 0.9 | 1.0 | 0.2 | 1.0 | 1.0 | 1.0 | 1.2 | 0.005 | 0.005 | 0.01 | 0.005 |
| 11 | 0.9 | 1.0 | 0.3 | 1.0 | 1.0 | 1.0 | 1.2 | 0.005 | 0.005 | 0.01 | 0.005 |
| 12 | 0.9 | 1.0 | 0.7 | 1.0 | 1.0 | 1.0 | 1.2 | 0.005 | 0.005 | 0.01 | 0.005 |
| 13 | 0.9 | 1.0 | 1.0 | 1.0 | 1.0 | 1.0 | 1.2 | 0.005 | 0.005 | 0.01 | 0.005 |
| 14 | 0.9 | 1.0 | 0.5 | 0.5 | 1.0 | 1.0 | 1.2 | 0.005 | 0.005 | 0.91 | 0.005 |
| 15 | 0.9 | 1.0 | 0.5 | 0.8 | 1.0 | 1.0 | 1.2 | 0.005 | 0.005 | 0.01 | 0.005 |
| 16 | 0.9 | 1.0 | 0.5 | 1.3 | 1.0 | 1.0 | 1.2 | 0.005 | 0.005 | 0.01 | 0.005 |
| 17 | 0.9 | 1.0 | 0.5 | 1.5 | 1.0 | 1.0 | 1.2 | 0.005 | 0.005 | 0.01 | 0.005 |
| 18 | 0.9 | 1.0 | 0.5 | 1.0 | 0.1 | 1.0 | 1.2 | 0.005 | 0.005 | 0.01 | 0.005 |
| 19 | 0.9 | 1.0 | 0.5 | 1.0 | 0.3 | 1.0 | 1.2 | 0.005 | 0.005 | 0.01 | 0.005 |
| 20 | 0.9 | 1.0 | 0.5 | 1.0 | 1.0 | 1.0 | 1.2 | 0.005 | 0.005 | 0.01 | 0.005 |
| 21 | 0.9 | 1.0 | 0.5 | 1.0 | 1.5 | 1.0 | 1.2 | 0.005 | 0.005 | 0.01 | 0.005 |
| 22 | 0.9 | 1.0 | 0.5 | 1.0 | 1.0 | 0.4 | 1.2 | 0.005 | 0.005 | 0.01 | 0.005 |
| 23 | 0.9 | 1.0 | 0.5 | 1.0 | 1.0 | 0.6 | 1.2 | 0.005 | 0.005 | 0.01 | 0.005 |
| 24 | 0.9 | 1.0 | 0.5 | 1.0 | 1.0 | 1.9 | 1.2 | 0.005 | 0.005 | 0.01 | 0.005 |
| 25 | 0.9 | 1.0 | 0.5 | 1.0 | 1.0 | 3.0 | 1.2 | 0.005 | 0.005 | 0.01 | 0.005 |

TABLE 1(b)

| Run No. | Additive element | | | | | | | | | | |
|---|---|---|---|---|---|---|---|---|---|---|---|
| Example | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 26 | 0.9 | 1.0 | 0.5 | 1.0 | 1.0 | 1.0 | 0.5 | 0.005 | 0.005 | 0.01 | 0.005 |
| 27 | 0.9 | 1.0 | 0.5 | 1.0 | 1.0 | 1.0 | 1.0 | 0.005 | 0.005 | 0.01 | 0.005 |
| 28 | 0.9 | 1.0 | 0.5 | 1.0 | 1.0 | 1.0 | 1.5 | 0.005 | 0.005 | 0.01 | 0.005 |
| 29 | 0.9 | 1.0 | 0.5 | 1.0 | 1.0 | 1.0 | 2.5 | 0.005 | 0.005 | 0.01 | 0.005 |
| 30 | 0.9 | 1.0 | 0.5 | 1.0 | 1.0 | 1.0 | 1.2 | 0.001 | 0.005 | 0.01 | 0.005 |
| 31 | 0.9 | 1.0 | 0.5 | 1.0 | 1.0 | 1.0 | 1.2 | 0.002 | 0.005 | 0.01 | 0.005 |
| 32 | 0.9 | 1.0 | 0.5 | 1.0 | 1.0 | 1.0 | 1.2 | 0.03 | 0.005 | 0.01 | 0.005 |
| 33 | 0.9 | 1.0 | 0.5 | 1.0 | 1.0 | 1.0 | 1.2 | 0.05 | 0.005 | 0.01 | 0.005 |
| 34 | 0.9 | 1.0 | 0.5 | 1.0 | 1.0 | 1.0 | 1.2 | 0.005 | 0.0001 | 0.01 | 0.005 |
| 35 | 0.9 | 1.0 | 0.5 | 1.0 | 1.0 | 1.0 | 1.2 | 0.005 | 0.001 | 0.01 | 0.005 |
| 36 | 0.9 | 1.0 | 0.5 | 1.0 | 1.0 | 1.0 | 1.2 | 0.005 | 0.03 | 0.01 | 0.005 |
| 37 | 0.9 | 1.0 | 0.5 | 1.0 | 1.0 | 1.0 | 1.2 | 0.005 | 0.05 | 0.01 | 0.005 |
| 38 | 0.9 | 1.0 | 0.5 | 1.0 | 1.0 | 1.0 | 1.2 | 0.005 | 0.005 | 0.0001 | 0.005 |
| 39 | 0.9 | 1.0 | 0.5 | 1.0 | 1.0 | 1.0 | 1.2 | 0.005 | 0.005 | 0.001 | 0.005 |
| 40 | 0.9 | 1.0 | 0.5 | 1.0 | 1.0 | 1.0 | 1.2 | 0.005 | 0.005 | 0.03 | 0.005 |
| 41 | 0.9 | 1.0 | 0.5 | 1.0 | 0.1 | 1.0 | 1.2 | 0.005 | 0.005 | 0.05 | 0.005 |
| 42 | 0.9 | 1.0 | 0.5 | 1.0 | 0.3 | 1.0 | 1.2 | 0.005 | 0.005 | 0.01 | 0.0005 |
| 43 | 0.9 | 1.0 | 0.5 | 1.0 | 1.0 | 1.0 | 1.2 | 0.005 | 0.005 | 0.01 | 0.001 |

TABLE 1(b)-continued

| Run No. Example | Additive element | | | | | | | | | | |
|---|---|---|---|---|---|---|---|---|---|---|---|
| | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 44 | 0.9 | 1.0 | 0.5 | 1.0 | 1.5 | 1.0 | 1.2 | 0.005 | 0.005 | 0.01 | 0.05 |
| 45 | 0.9 | 1.0 | 0.5 | 1.0 | 1.0 | 1.0 | 1.2 | 0.005 | 0.005 | 0.01 | 0.1 |
| 46 | 0.9 | 1.0 | 0.5 | 1.0 | 1.0 | 1.0 | 1.2 | 0.005 | 0.005 | 0.01 | 0.005 |
| 47 | 0.9 | 1.0 | 0.5 | 1.0 | 1.0 | 1.0 | 1.2 | 0.005 | 0.005 | 0.01 | 0.005 |
| 48 | 0.9 | 1.0 | 0.5 | 1.0 | 1.0 | 1.0 | 1.2 | 0.005 | 0.005 | 0.01 | 0.005 |
| 49 | 0.9 | 1.0 | 0.5 | 1.0 | 1.0 | 1.0 | 1.2 | 0.005 | 0.005 | 0.01 | 0.005 |

TABLE 1(c)

| Run No. Comparative Example | Additive element | | | | | | | | | | |
|---|---|---|---|---|---|---|---|---|---|---|---|
| | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 1 | 0.1 | 1.0 | 0.5 | 1.0 | 1.0 | 1.0 | 1.2 | 0.005 | 0.005 | 0.01 | 0.005 |
| 2 | 2.0 | 1.0 | 0.5 | 1.0 | 1.0 | 1.0 | 1.2 | 0.005 | 0.005 | 0.01 | 0.005 |
| 3 | 0.9 | 0.1 | 0.5 | 1.0 | 1.0 | 1.0 | 1.2 | 0.005 | 0.005 | 0.01 | 0.005 |
| 4 | 0.9 | 2.0 | 0.5 | 1.0 | 1.0 | 1.0 | 1.2 | 0.005 | 0.005 | 0.01 | 0.005 |
| 5 | 0.9 | 1.0 | 0.1 | 1.0 | 1.0 | 1.0 | 1.2 | 0.005 | 0.005 | 0.01 | 0.005 |
| 6 | 0.9 | 1.0 | 1.5 | 1.0 | 1.0 | 1.0 | 1.2 | 0.005 | 0.005 | 0.01 | 0.005 |
| 7 | 0.9 | 1.0 | 0.5 | 0.1 | 1.0 | 1.0 | 1.2 | 0.005 | 0.005 | 0.01 | 0.005 |
| 8 | 0.9 | 1.0 | 0.5 | 2.0 | 1.0 | 1.0 | 1.2 | 0.005 | 0.005 | 0.01 | 0.005 |
| 9 | 0.9 | 1.0 | 0.5 | 1.0 | 0 | 1.0 | 1.2 | 0.005 | 0.005 | 0.01 | 0.005 |
| 10 | 0.9 | 1.0 | 0.5 | 1.0 | 2.0 | 1.0 | 1.2 | 0.005 | 0.005 | 0.01 | 0.005 |
| 11 | 0.9 | 1.0 | 0.5 | 1.0 | 1.0 | 0.1 | 1.2 | 0.005 | 0.005 | 0.01 | 0.005 |
| 12 | 0.9 | 1.0 | 0.5 | 1.0 | 1.0 | 3.5 | 1.2 | 0.005 | 0.005 | 0.01 | 0.005 |
| 13 | 0.9 | 1.0 | 0.5 | 1.0 | 1.0 | 1.0 | 0.1 | 0.005 | 0.005 | 0.01 | 0.005 |
| 14 | 0.9 | 1.0 | 0.5 | 1.0 | 1.0 | 1.0 | 3.0 | 0.005 | 0.005 | 0.01 | 0.005 |
| 15 | 0.9 | 1.0 | 0.5 | 1.0 | 1.0 | 1.0 | 1.2 | 0 | 0.005 | 0.01 | 0.005 |
| 16 | 0.9 | 1.0 | 0.5 | 1.0 | 1.0 | 1.0 | 1.2 | 0.1 | 0.005 | 0.01 | 0.005 |
| 17 | 0.9 | 1.0 | 0.5 | 1.0 | 1.0 | 1.0 | 1.2 | 0.005 | 0 | 0.01 | 0.005 |
| 18 | 0.9 | 1.0 | 0.5 | 1.0 | 1.0 | 1.0 | 1.2 | 0.005 | 0.1 | 0.01 | 0.005 |
| 19 | 0.9 | 1.0 | 0.5 | 1.0 | 1.0 | 1.0 | 1.2 | 0.005 | 0.005 | 0 | 0.005 |
| 20 | 0.9 | 1.0 | 0.5 | 1.0 | 1.0 | 1.0 | 1.2 | 0.005 | 0.005 | 0.1 | 0.005 |
| 21 | 0.9 | 1.0 | 0.5 | 1.0 | 1.0 | 1.0 | 1.2 | 0.005 | 0.005 | 0.01 | 0 |
| 22 | 0.9 | 1.0 | 0.5 | 1.0 | 1.0 | 1.0 | 1.2 | 0.005 | 0.005 | 0.01 | 0.5 |
| 23 | 0.9 | 1.0 | 0.5 | 1.0 | 1.0 | 1.0 | 1.2 | 0.005 | 0.005 | 0.01 | 0.005 |
| 24 | 0.9 | 1.0 | 0.5 | 1.0 | 1.0 | 1.0 | 1.2 | 0.005 | 0.005 | 0.01 | 0.005 |
| 25 | 0.9 | 1.0 | 0.5 | 1.0 | 1.0 | 1.0 | 1.2 | 0.005 | 0.005 | 0.01 | 0 |

TABLE 1(d)

| Run No. Example | $\gamma$-$Bi_2O_3$ phase (wt. %) | Life under electrical stress | Lightning current impulse withstand capability (KJ) | Switching current impulse withstand capability (KJ) | $V_{40KA}/V_{1A}$ | $\Delta V_{1A}$ | Water penetration |
|---|---|---|---|---|---|---|---|
| 1 | 31 | ∘ | 16.2 | 19.2 | 1.75 | 2.2 | ∘ |
| 2 | 60 | ◎ | 17.0 | 20.6 | 1.75 | 1.0 | ∘ |
| 3 | 91 | ◎ | 17.2 | 20.0 | 1.75 | 0.5 | ∘ |
| 4 | 93 | ◎ | 17.1 | 20.3 | 1.77 | 0.5 | ∘ |
| 5 | 95 | ◎ | 16.3 | 18.3 | 1.80 | 2.1 | ∘ |
| 6 | 88 | ◎ | 17.0 | 19.3 | 1.84 | 3.3 | ∘ |
| 7 | 90 | ◎ | 17.0 | 19.9 | 1.76 | 1.0 | ∘ |
| 8 | 87 | ◎ | 17.5 | 19.8 | 1.77 | 1.0 | ∘ |
| 9 | 91 | ◎ | 16.9 | 19.1 | 1.86 | 3.6 | ∘ |
| 10 | 84 | ∘ | 17.0 | 20.4 | 1.75 | 1.0 | ∘ |
| 11 | 87 | ◎ | 17.4 | 20.1 | 1.75 | 0.5 | ∘ |
| 12 | 89 | ◎ | 17.3 | 20.3 | 1.76 | 1.0 | ∘ |
| 13 | 90 | ∘ | 17.1 | 20.6 | 1.77 | 1.5 | ∘ |
| 14 | 86 | ◎ | 16.8 | 19.5 | 1.80 | 2.3 | ∘ |
| 15 | 85 | ◎ | 17.3 | 20.3 | 1.75 | 1.0 | ∘ |
| 16 | 84 | ◎ | 17.6 | 19.5 | 1.76 | 1.0 | ∘ |
| 17 | 87 | ∘ | 16.0 | 17.6 | 1.88 | 2.6 | ∘ |
| 18 | 89 | ∘ | 17.0 | 20.1 | 1.76 | 2.6 | ∘ |
| 19 | 91 | ◎ | 17.5 | 20.5 | 1.76 | 1.0 | ∘ |
| 20 | 90 | ◎ | 17.0 | 20.0 | 1.77 | 0.5 | ∘ |
| 21 | 87 | ∘ | 17.0 | 20.1 | 1.77 | 0.5 | ∘ |
| 22 | 30 | ∘ | 16.0 | 18.7 | 1.83 | 2.9 | ∘ |
| 23 | 56 | ◎ | 17.0 | 20.1 | 1.77 | 0.5 | ∘ |
| 24 | 60 | ◎ | 17.5 | 20.9 | 1.78 | 1.0 | ∘ |
| 25 | 33 | ∘ | 18.0 | 21.3 | 1.87 | 3.1 | ∘ |

TABLE 1(e)

| Run No. Example | $\gamma$-$Bi_2O_3$ phase (wt. %) | Life under electrical stress | Lightning current impulse withstand capability (KJ) | Switching current impulse withstand capability (KJ) | $V_{40KA}/V_{1A}$ | $\Delta V_{1A}$ | Water penetration |
|---|---|---|---|---|---|---|---|
| 26 | 89 | ◎ | 16.6 | 20.1 | 1.79 | 2.0 | ∘ |

TABLE 1(e)-continued

| Run No. Example | $\gamma$-$Bi_2O_3$ phase (wt. %) | Life under electrical stress | Lightning current impulse withstand capability (KJ) | Switching current impulse withstand capability (KJ) | $V_{40KA}/V_{1A}$ | $\Delta V_{1A}$ | Water penetration |
|---|---|---|---|---|---|---|---|
| 27 | 88 | ◎ | 17.0 | 20.0 | 1.76 | 1.0 | ○ |
| 28 | 90 | ◎ | 17.0 | 19.5 | 1.79 | 1.0 | ○ |
| 29 | 91 | ○ | 16.3 | 18.7 | 1.82 | 3.2 | ○ |
| 30 | 92 | ◎ | 17.0 | 20.0 | 1.93 | 0.5 | ○ |
| 31 | 90 | ◎ | 17.2 | 20.1 | 1.80 | 0.5 | ○ |
| 32 | 88 | ◎ | 17.9 | 20.3 | 1.73 | 1.0 | ○ |
| 33 | 87 | ○ | 18.3 | 19.5 | 1.70 | 4.3 | ○ |
| 34 | 36 | ○ | 17.4 | 19.6 | 1.81 | 3.1 | ○ |
| 35 | 52 | ◎ | 17.3 | 20.0 | 1.75 | 0.5 | ○ |
| 36 | 96 | ◎ | 17.2 | 20.1 | 1.80 | 1.0 | ○ |
| 37 | 97 | ◎ | 16.9 | 19.1 | 1.89 | 3.9 | ○ |
| 38 | 90 | ○ | 16.8 | 19.9 | 1.75 | 1.8 | ○ |
| 39 | 91 | ◎ | 17.2 | 19.9 | 1.74 | 0.5 | ○ |
| 40 | 89 | ◎ | 17.9 | 19.8 | 1.76 | 1.5 | ○ |
| 41 | 90 | ○ | 18.0 | 19.0 | 1.78 | 2.6 | ○ |
| 42 | 92 | ◎ | 17.0 | 19.5 | 1.80 | 0.5 | ○ |
| 43 | 90 | ◎ | 17.3 | 19.1 | 1.75 | 0.5 | ○ |
| 44 | 89 | ◎ | 17.0 | 19.3 | 1.75 | 1.0 | ○ |
| 45 | 87 | ○ | 16.5 | 19.0 | 1.79 | 3.1 | ○ |
| 46 | 30 | ○ | 16.3 | 19.8 | 1.80 | 3.9 | ○ |
| 47 | 50 | ◎ | 17.0 | 20.2 | 1.76 | 2.9 | ○ |
| 48 | 81 | ◎ | 17.1 | 20.6 | 1.75 | 1.0 | ○ |
| 49 | 100 | ◎ | 17.5 | 21.0 | 1.76 | 0.5 | ○ |

TABLE 1(f)

| Run No. Comparative Example | $\gamma$-$Bi_2O_3$ phase (wt. %) | Life under electrical stress | Lightning current impulse withstand capability (KJ) | Switching current impulse withstand capability (KJ) | $V_{40KA}/V_{1A}$ | $\Delta V_{1A}$ | Water penetration |
|---|---|---|---|---|---|---|---|
| 1 | 4 | x | 12.1 | 15.3 | 1.79 | 7.0 | ○ |
| 2 | 95 | ○ | 14.3 | 15.6 | 1.83 | 1.0 | x |
| 3 | 88 | ◎ | 16.5 | 18.8 | 2.03 | 8.7 | ○ |
| 4 | 91 | ○ | 16.6 | 18.9 | 2.09 | 8.2 | ○ |
| 5 | 83 | x | 16.8 | 19.8 | 1.76 | 1.0 | ○ |
| 6 | 90 | x | 16.9 | 19.1 | 1.78 | 2.0 | ○ |
| 7 | 86 | ◎ | 13.7 | 18.3 | 1.86 | 5.2 | ○ |
| 8 | 87 | ○ | 12.9 | 11.7 | 2.10 | 5.4 | ○ |
| 9 | 88 | x | 16.0 | 19.6 | 1.80 | 5.3 | ○ |
| 10 | 90 | x | 16.3 | 19.8 | 1.80 | 1.0 | x |
| 11 | 22 | x | 11.1 | 15.0 | 2.11 | 5.6 | ○ |
| 12 | 26 | ○ | 17.0 | 20.1 | 2.09 | 8.6 | x |
| 13 | 89 | ◎ | 16.1 | 19.8 | 1.80 | 7.3 | ○ |
| 14 | 90 | x | 15.8 | 15.4 | 2.00 | 9.1 | ○ |
| 15 | 92 | ◎ | 15.0 | 19.3 | 2.33 | 0.5 | ○ |
| 16 | 85 | x | 17.5 | 19.0 | 1.75 | 11.9 | ○ |
| 17 | 11 | x | 17.0 | 19.4 | 1.80 | 7.0 | x |
| 18 | 96 | ○ | 16.5 | 19.0 | 2.16 | 9.9 | ○ |
| 19 | 89 | x | 15.8 | 19.0 | 1.80 | 3.9 | ○ |
| 20 | 88 | x | 17.6 | 18.5 | 1.82 | 4.4 | ○ |
| 21 | 93 | ◎ | 15.4 | 19.0 | 1.99 | 1.5 | x |
| 22 | 96 | x | 14.0 | 18.3 | 2.22 | 8.7 | ○ |
| 23 | 19 | x | 14.2 | 18.7 | 1.90 | 6.6 | ○ |
| 24 | 22 | x | 14.6 | 18.8 | 1.90 | 6.1 | ○ |
| 25 | 18 | x | 13.9 | 18.6 | 1.99 | 6.6 | x |

In Table 1, the amount of the $\gamma$-$Bi_2O_3$ phase in a resistor was represented by a weight percent of the $\gamma$-$Bi_2O_3$ phase content determined by an X-ray diffraction method in the bismuth oxide content in the resistor quantitatively determined by chemical analysis. The life under electrical stress was converted from an Arrhenius' plot. Resistors good for 50 years or more under a voltage applying rate of 85% at 40° C. were represented by the mark ○ and particularly, those good for 100 years or more under a voltage applying rate of 85% at 40° C. were represented by the mark ◎. The lightning current impulse withstand capability was determined as an energy value (passed value) converted from a withstand capability after 2 repetition of applying, with a 5 minute interval, lightning current impulse with a waveform of 4/10 μs. The switching current impulse withstand capability was determined as an energy value (passed value) converted from a withstand capability after 20 repetitive applying a switching current impulse with a waveform of 2 ms. The discharge voltage ratio was obtained as a ratio of a varistor voltage ($V_{1A}$) to a discharge voltage ($V_{40KA}$) when a current of 40 KA with a waveform of 4/10 μs was applied. The change rate of the discharge voltage after applying current impulse was calculated from varistor voltage ($\Delta V_{1A}$) before and after 10 repetition of applying a current of 40 KA with a waveform of 4/10 μs. This value represents a decrease rate against an initial value. With respect to the water penetrating characteristics, a resistor was immersed in a fluorescent flaw detective solution for 24 hours under a pressure of 200 kg/cm$^2$ and then a water penetrating condition was inspected. The mark ○ represents no penetration and the mark x represents penetrations observed.

It is understood from the results shown in Table 1 that Samples No. 1–49 containing additives and $\gamma$-$Bi_2O_3$ all in an amount falling within the scope defined by the first embodiment of the present invention are satisfactory in all characteristics, different from Comparative Samples Nos. 1–25 which do not meet some of the requirements of the present invention. Though oxides were used as a starting material in the examples of the present invention, it is natural that the same effect can be obtained by using compounds convertible to oxides during firing, such as carbonates, nitrates, hydroxides or the like. Besides the additives recited in claims, needless to say, other materials also may be incorporated in accordance with a use object of the non-linear resistors.

EXAMPLE 2

Using the additive elements inside or outside the scope of the present invention shown in Table 2, voltage non-linear resistors having a diameter of 47 mm and a thickness of 22.5 mm were prepared. The $\gamma$-$Bi_2O_3$ phase content, life under electrical stress, lightning current impulse withstand capability, switching current impulse withstand capability, discharge voltage ratio, change rate of discharge voltage after applying current impulse and water penetrating characteristics in each resistor, were determined. Each resistor had a $V_{1mA}$ within the range of 300–550 V/mm. As the silicon oxides, an amorphous silica was used and as the zirconium oxides, zirconium nitrate was used. Further, as the cobalt oxides, that in the form of $Co_3O_4$ was used. As the silver oxides and the boron oxides, a bismuth borosilicate glass containing silver was used. The heat treatment was conducted at 450°–900° C. The results are shown in Table 2.

TABLE 2(a)

| Run No. | Additive element | | | | | | | | | | |
|---|---|---|---|---|---|---|---|---|---|---|---|
| Example | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 50 | 0.3 | 1.0 | 0.5 | 1.0 | 0.5 | 7.0 | 1.2 | 0.004 | 0.02 | 0.006 | 0.005 |
| 51 | 0.5 | 1.0 | 0.5 | 1.0 | 0.5 | 7.0 | 1.2 | 0.004 | 0.02 | 0.006 | 0.005 |
| 52 | 0.8 | 1.0 | 0.5 | 1.0 | 0.5 | 7.0 | 1.2 | 0.004 | 0.02 | 0.006 | 0.005 |
| 53 | 1.0 | 1.0 | 0.5 | 1.0 | 0.5 | 7.0 | 1.2 | 0.004 | 0.02 | 0.006 | 0.005 |
| 54 | 1.5 | 1.0 | 0.5 | 1.0 | 0.5 | 7.0 | 1.2 | 0.004 | 0.02 | 0.006 | 0.005 |
| 55 | 0.8 | 0.3 | 0.5 | 1.0 | 0.5 | 7.0 | 1.2 | 0.004 | 0.02 | 0.006 | 0.005 |
| 56 | 0.8 | 0.5 | 0.5 | 1.0 | 0.5 | 7.0 | 1.2 | 0.004 | 0.02 | 0.006 | 0.005 |
| 57 | 0.8 | 1.2 | 0.5 | 1.0 | 0.5 | 7.0 | 1.2 | 0.004 | 0.02 | 0.006 | 0.005 |
| 58 | 0.8 | 1.5 | 0.5 | 1.0 | 0.5 | 7.0 | 1.2 | 0.004 | 0.02 | 0.006 | 0.005 |
| 59 | 0.8 | 1.0 | 0.2 | 1.0 | 0.5 | 7.0 | 1.2 | 0.004 | 0.02 | 0.006 | 0.005 |
| 60 | 0.8 | 1.0 | 0.3 | 1.0 | 0.5 | 7.0 | 1.2 | 0.004 | 0.02 | 0.006 | 0.005 |
| 61 | 0.8 | 1.0 | 1.0 | 1.0 | 0.5 | 7.0 | 1.2 | 0.004 | 0.02 | 0.006 | 0.005 |
| 62 | 0.8 | 1.0 | 1.5 | 1.0 | 0.5 | 7.0 | 1.2 | 0.004 | 0.02 | 0.006 | 0.005 |
| 63 | 0.8 | 1.0 | 0.5 | 0.5 | 0.5 | 7.0 | 1.2 | 0.004 | 0.02 | 0.006 | 0.005 |
| 64 | 0.8 | 1.0 | 0.5 | 0.8 | 0.5 | 7.0 | 1.2 | 0.004 | 0.02 | 0.006 | 0.005 |
| 65 | 0.8 | 1.0 | 0.5 | 1.3 | 0.5 | 7.0 | 1.2 | 0.004 | 0.02 | 0.006 | 0.005 |
| 66 | 0.8 | 1.0 | 0.5 | 1.5 | 0.5 | 7.0 | 1.2 | 0.004 | 0.02 | 0.006 | 0.005 |
| 67 | 0.8 | 1.0 | 0.5 | 1.0 | 0.1 | 7.0 | 1.2 | 0.004 | 0.02 | 0.006 | 0.005 |
| 68 | 0.8 | 1.0 | 0.5 | 1.0 | 0.3 | 7.0 | 1.2 | 0.004 | 0.02 | 0.006 | 0.005 |
| 69 | 0.8 | 1.0 | 0.5 | 1.0 | 1.0 | 7.0 | 1.2 | 0.004 | 0.02 | 0.006 | 0.005 |
| 70 | 0.8 | 1.0 | 0.5 | 1.0 | 1.5 | 7.0 | 1.2 | 0.004 | 0.02 | 0.006 | 0.005 |
| 71 | 0.8 | 1.0 | 0.5 | 1.0 | 0.5 | 4.0 | 1.2 | 0.004 | 0.02 | 0.006 | 0.005 |
| 72 | 0.8 | 1.0 | 0.5 | 1.0 | 0.5 | 6.0 | 1.2 | 0.004 | 0.02 | 0.006 | 0.005 |
| 73 | 0.8 | 1.0 | 0.5 | 1.0 | 0.5 | 9.0 | 1.2 | 0.004 | 0.02 | 0.006 | 0.005 |
| 74 | 0.8 | 1.0 | 0.5 | 1.0 | 0.5 | 10.0 | 1.2 | 0.004 | 0.02 | 0.006 | 0.005 |

TABLE 2(b)

| Run No. | Additive element | | | | | | | | | | |
|---|---|---|---|---|---|---|---|---|---|---|---|
| Example | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 75 | 0.8 | 1.0 | 0.5 | 1.0 | 0.5 | 7.0 | 0.5 | 0.004 | 0.02 | 0.006 | 0.005 |
| 76 | 0.8 | 1.0 | 0.5 | 1.0 | 0.5 | 7.0 | 1.0 | 0.004 | 0.02 | 0.006 | 0.005 |
| 77 | 0.8 | 1.0 | 0.5 | 1.0 | 0.5 | 7.0 | 1.5 | 0.004 | 0.02 | 0.006 | 0.005 |
| 78 | 0.8 | 1.0 | 0.5 | 1.0 | 0.5 | 7.0 | 2.5 | 0.004 | 0.02 | 0.006 | 0.005 |
| 79 | 0.8 | 1.0 | 0.5 | 1.0 | 0.5 | 7.0 | 1.2 | 0.001 | 0.02 | 0.006 | 0.005 |
| 80 | 0.8 | 1.0 | 0.5 | 1.0 | 0.5 | 7.0 | 1.2 | 0.002 | 0.02 | 0.006 | 0.005 |
| 81 | 0.8 | 1.0 | 0.5 | 1.0 | 0.5 | 7.0 | 1.2 | 0.02 | 0.02 | 0.006 | 0.005 |
| 82 | 0.8 | 1.0 | 0.5 | 1.0 | 0.5 | 7.0 | 1.2 | 0.05 | 0.02 | 0.006 | 0.005 |
| 83 | 0.8 | 1.0 | 0.5 | 1.0 | 0.5 | 7.0 | 1.2 | 0.004 | 0.001 | 0.006 | 0.005 |
| 84 | 0.8 | 1.0 | 0.5 | 1.0 | 0.5 | 7.0 | 1.2 | 0.004 | 0.001 | 0.006 | 0.005 |
| 85 | 0.8 | 1.0 | 0.5 | 1.0 | 0.5 | 7.0 | 1.2 | 0.004 | 0.03 | 0.006 | 0.005 |
| 86 | 0.8 | 1.0 | 0.5 | 1.0 | 0.5 | 7.0 | 1.2 | 0.004 | 0.05 | 0.006 | 0.005 |
| 87 | 0.8 | 1.0 | 0.5 | 1.0 | 0.5 | 7.0 | 1.2 | 0.004 | 0.02 | 0.0001 | 0.005 |
| 88 | 0.8 | 1.0 | 0.5 | 1.0 | 0.5 | 7.0 | 1.2 | 0.004 | 0.02 | 0.001 | 0.005 |
| 89 | 0.8 | 1.0 | 0.5 | 1.0 | 0.5 | 7.0 | 1.2 | 0.004 | 0.02 | 0.03 | 0.005 |
| 90 | 0.8 | 1.0 | 0.5 | 1.0 | 0.5 | 7.0 | 1.2 | 0.004 | 0.02 | 0.05 | 0.005 |
| 91 | 08 | 1.0 | 0.5 | 1.0 | 0.5 | 7.0 | 1.2 | 0.004 | 0.02 | 0.006 | 0.0005 |
| 92 | 0.8 | 1.0 | 0.5 | 1.0 | 0.5 | 7.0 | 1.2 | 0.004 | 0.02 | 0.006 | 0.001 |
| 93 | 0.8 | 1.0 | 0.5 | 1.0 | 0.5 | 7.0 | 1.2 | 0.004 | 0.02 | 0.006 | 0.05 |
| 94 | 0.8 | 1.0 | 0.5 | 1.0 | 0.5 | 7.0 | 1.2 | 0.004 | 0.02 | 0.006 | 0.1 |
| 95 | 0.8 | 1.0 | 0.5 | 1.0 | 0.5 | 7.0 | 1.2 | 0.004 | 0.02 | 0.006 | 0.005 |
| 96 | 0.8 | 1.0 | 0.5 | 1.0 | 0.5 | 7.0 | 1.2 | 0.004 | 0.02 | 0.006 | 0.005 |
| 97 | 0.8 | 1.0 | 0.5 | 1.0 | 0.5 | 7.0 | 1.2 | 0.004 | 0.02 | 0.006 | 0.005 |
| 98 | 0.8 | 1.0 | 0.5 | 1.0 | 0.5 | 7.0 | 1.2 | 0.004 | 0.02 | 0.006 | 0.005 |

TABLE 2(c)

| Run No. Comparative Example | Additive element | | | | | | | | | | |
|---|---|---|---|---|---|---|---|---|---|---|---|
| | $Bi_2O_3$ | $Co_2O_3$ | $MnO_2$ | $Sb_2O_3$ | $Cr_2O_3$ | $SiO_2$ | NiO | $Al_2O_3$ | $B_2O_3$ | $Ag_2O$ | $ZrO_2$ |
| 26 | 0.1 | 1.0 | 0.5 | 1.0 | 0.5 | 7.0 | 1.2 | 0.004 | 0.02 | 0.006 | 0.005 |
| 27 | 2.0 | 1.0 | 0.5 | 1.0 | 0.5 | 7.0 | 1.2 | 0.004 | 0.02 | 0.006 | 0.005 |
| 28 | 0.8 | 0.1 | 0.5 | 1.0 | 0.5 | 7.0 | 1.2 | 0.004 | 0.02 | 0.006 | 0.005 |
| 29 | 0.8 | 2.0 | 0.5 | 1.0 | 0.5 | 7.0 | 1.2 | 0.004 | 0.02 | 0.006 | 0.005 |
| 30 | 0.8 | 1.0 | 0.1 | 1.0 | 0.5 | 7.0 | 1.2 | 0.004 | 0.02 | 0.006 | 0.005 |
| 31 | 0.8 | 1.0 | 2.0 | 1.0 | 0.5 | 7.0 | 1.2 | 0.004 | 0.02 | 0.006 | 0.005 |
| 32 | 0.8 | 1.0 | 0.5 | 0.1 | 0.5 | 7.0 | 1.2 | 0.004 | 0.02 | 0.006 | 0.005 |
| 33 | 0.8 | 1.0 | 0.5 | 2.0 | 0.5 | 7.0 | 1.2 | 0.004 | 0.02 | 0.006 | 0.005 |
| 34 | 0.8 | 1.0 | 0.5 | 1.0 | 0 | 7.0 | 1.2 | 0.004 | 0.02 | 0.006 | 0.005 |
| 35 | 0.8 | 1.0 | 0.5 | 1.0 | 2.0 | 7.0 | 1.2 | 0.004 | 0.02 | 0.006 | 0.005 |
| 36 | 0.8 | 1.0 | 0.5 | 1.0 | 0.5 | 3.0 | 1.2 | 0.004 | 0.02 | 0.006 | 0.005 |
| 37 | 0.8 | 1.0 | 0.5 | 1.0 | 0.5 | 11.0 | 1.2 | 0.004 | 0.02 | 0.006 | 0.005 |
| 38 | 0.8 | 1.0 | 0.5 | 1.0 | 0.5 | 7.0 | 0.1 | 0.004 | 0.02 | 0.006 | 0.005 |
| 39 | 0.8 | 1.0 | 0.5 | 1.0 | 0.5 | 7.0 | 3.0 | 0.004 | 0.02 | 0.006 | 0.005 |
| 40 | 0.8 | 1.0 | 0.5 | 1.0 | 0.5 | 7.0 | 1.2 | 0 | 0.02 | 0.006 | 0.005 |
| 41 | 0.8 | 1.0 | 0.5 | 1.0 | 0.5 | 7.0 | 1.2 | 0.1 | 0.02 | 0.006 | 0.005 |
| 42 | 0.8 | 1.0 | 0.5 | 1.0 | 0.5 | 7.0 | 1.2 | 0.004 | 0 | 0.006 | 0.005 |
| 43 | 0.8 | 1.0 | 0.5 | 1.0 | 0.5 | 7.0 | 1.2 | 0.004 | 0.1 | 0.006 | 0.005 |
| 44 | 0.8 | 1.0 | 0.5 | 1.0 | 0.5 | 7.0 | 1.2 | 0.004 | 0.02 | 0 | 0.005 |
| 45 | 0.8 | 1.0 | 0.5 | 1.0 | 0.5 | 7.0 | 1.2 | 0.004 | 0.02 | 0.01 | 0.005 |
| 46 | 0.8 | 1.0 | 0.5 | 1.0 | 0.5 | 7.0 | 1.2 | 0.004 | 0.02 | 0.006 | 0 |
| 47 | 0.8 | 1.0 | 0.5 | 1.0 | 0.5 | 7.0 | 1.2 | 0.004 | 0.02 | 0.006 | 0.5 |
| 48 | 0.8 | 1.0 | 0.5 | 1.0 | 0.5 | 7.0 | 1.2 | 0.004 | 0.02 | 0.006 | 0.005 |
| 49 | 0.8 | 1.0 | 0.5 | 1.0 | 0.5 | 7.0 | 1.2 | 0.004 | 0.02 | 0.006 | 0.005 |
| 50 | 0.8 | 1.0 | 0.5 | 1.0 | 0.5 | 7.0 | 1.2 | 0.004 | 0.02 | 0.006 | 0 |

TABLE 2(d)

| Run No. Example | $\gamma$-$Bi_2O_3$ phase (wt. %) | Life under electrical stress | Lightning current impulse withstand capability (KJ) | Switching current impulse withstand capability (KJ) | $V_{30KA}/V_{1mA}$ | $\Delta V_{1mA}$ | Water penetration |
|---|---|---|---|---|---|---|---|
| 50 | 30 | ○ | 13.3 | 11.2 | 1.95 | 3.3 | ○ |
| 51 | 51 | ◎ | 13.9 | 12.9 | 1.95 | 1.0 | ○ |
| 52 | 61 | ◎ | 14.5 | 13.0 | 2.00 | 1.0 | ○ |
| 53 | 75 | ◎ | 15.0 | 13.5 | 2.03 | 0.5 | ○ |
| 54 | 90 | ◎ | 13.6 | 12.4 | 2.08 | 1.5 | ○ |
| 55 | 59 | ○ | 14.0 | 13.0 | 1.96 | 3.9 | ○ |
| 56 | 61 | ◎ | 14.2 | 12.8 | 2.03 | 1.0 | ○ |
| 57 | 63 | ◎ | 13.9 | 12.9 | 2.04 | 1.8 | ○ |
| 58 | 65 | ◎ | 13.9 | 12.8 | 1.97 | 4.2 | ○ |
| 59 | 60 | ○ | 13.6 | 12.8 | 2.00 | 1.0 | ○ |
| 60 | 61 | ◎ | 14.0 | 13.1 | 2.01 | 1.5 | ○ |
| 61 | 59 | ◎ | 14.5 | 13.0 | 1.98 | 1.0 | ○ |
| 62 | 58 | ○ | 14.0 | 13.0 | 2.01 | 2.5 | ○ |
| 63 | 58 | ◎ | 13.7 | 13.0 | 2.03 | 3.6 | ○ |
| 64 | 60 | ◎ | 14.6 | 13.3 | 1.95 | 1.0 | ○ |
| 65 | 61 | ◎ | 14.2 | 13.0 | 2.01 | 1.0 | ○ |
| 66 | 57 | ◎ | 13.1 | 12.1 | 2.13 | 4.4 | ○ |
| 67 | 55 | ○ | 14.2 | 13.3 | 2.02 | 2.7 | ○ |
| 68 | 58 | ◎ | 14.1 | 13.2 | 2.02 | 1.0 | ○ |
| 69 | 59 | ◎ | 13.9 | 13.3 | 2.02 | 0.5 | ○ |
| 70 | 60 | ○ | 13.5 | 13.0 | 2.04 | 1.0 | ○ |
| 71 | 40 | ○ | 13.9 | 12.9 | 2.04 | 2.5 | ○ |
| 72 | 59 | ◎ | 14.9 | 13.0 | 2.00 | 1.0 | ○ |
| 73 | 73 | ◎ | 14.0 | 12.4 | 2.02 | 1.0 | ○ |
| 74 | 81 | ○ | 13.0 | 11.7 | 2.16 | 7.1 | ○ |

TABLE 2(e)

| Run No. Example | $\gamma$-$Bi_2O_3$ phase (wt. %) | Life under electrical stress | Lightning current impulse withstand capability (KJ) | Switching current impulse withstand capability (KJ) | $V_{30KA}/V_{1mA}$ | $\Delta V_{1mA}$ | Water penetration |
|---|---|---|---|---|---|---|---|
| 75 | 59 | ◎ | 14.0 | 12.9 | 2.03 | 3.9 | ○ |
| 76 | 58 | ◎ | 14.4 | 13.2 | 2.01 | 1.0 | ○ |
| 77 | 57 | ◎ | 14.6 | 12.8 | 2.03 | 1.0 | ○ |
| 78 | 58 | ○ | 13.9 | 12.2 | 2.09 | 4.7 | ○ |
| 79 | 65 | ◎ | 13.0 | 13.0 | 2.14 | 0.5 | ○ |
| 80 | 64 | ◎ | 14.0 | 13.1 | 2.05 | 1.0 | ○ |
| 81 | 60 | ◎ | 15.0 | 13.3 | 1.95 | 4.9 | ○ |
| 82 | 62 | ○ | 14.4 | 13.0 | 1.94 | 9.8 | ○ |
| 83 | 32 | ○ | 14.0 | 13.3 | 1.96 | 1.0 | ○ |
| 84 | 53 | ◎ | 14.4 | 13.1 | 1.98 | 0.5 | ○ |
| 85 | 74 | ◎ | 14.4 | 13.2 | 2.02 | 1.0 | ○ |
| 86 | 86 | ◎ | 14.1 | 12.8 | 2.17 | 3.3 | ○ |
| 87 | 64 | ○ | 13.3 | 12.8 | 2.03 | 3.1 | ○ |
| 88 | 60 | ◎ | 14.0 | 13.0 | 2.01 | 1.0 | ○ |

TABLE 2(e)-continued

| Run No. Example | $\gamma$-$Bi_2O_3$ phase (wt. %) | Life under electrical stress | Lightning current impulse withstand capability (KJ) | Switching current impulse withstand capability (KJ) | $V_{30KA}/V_{1mA}$ | $\Delta V_{1mA}$ | Water penetration |
|---|---|---|---|---|---|---|---|
| 89 | 59 | ◎ | 14.6 | 13.3 | 2.02 | 0.5 | ○ |
| 90 | 62 | ○ | 14.8 | 13.1 | 2.04 | 2.9 | ○ |
| 91 | 58 | ◎ | 13.5 | 13.4 | 2.08 | 1.0 | ○ |
| 92 | 60 | ◎ | 14.1 | 12.8 | 2.02 | 1.0 | ○ |
| 93 | 61 | ◎ | 13.9 | 12.6 | 2.05 | 1.9 | ○ |
| 94 | 60 | ○ | 13.0 | 12.0 | 2.13 | 4.8 | ○ |
| 95 | 30 | ○ | 13.6 | 12.5 | 2.19 | 5.6 | ○ |
| 96 | 50 | ◎ | 14.0 | 12.5 | 2.06 | 2.4 | ○ |
| 97 | 85 | ◎ | 15.0 | 13.2 | 2.00 | 0.5 | ○ |
| 98 | 100 | ◎ | 14.8 | 12.8 | 2.04 | 1.0 | ○ |

TABLE 2(f)

| Run No. Example | $\gamma$-$Bi_2O_3$ phase (wt. %) | Life under electrical stress | Lightning current impulse withstand capability (KJ) | Switching current impulse withstand capability (KJ) | $V_{30KA}/V_{1mA}$ | $\Delta V_{1mA}$ | Water penetration |
|---|---|---|---|---|---|---|---|
| 26 | 22 | x | 11.3 | 8.5 | 2.01 | 6.7 | ○ |
| 27 | 86 | ○ | 12.1 | 10.3 | 2.13 | 2.3 | x |
| 28 | 59 | ○ | 13.7 | 12.8 | 2.13 | 10.3 | ○ |
| 29 | 64 | ○ | 13.9 | 12.7 | 2.18 | 11.1 | ○ |
| 30 | 60 | x | 13.9 | 12.8 | 2.03 | 2.3 | ○ |
| 31 | 59 | x | 13.5 | 12.7 | 2.01 | 3.6 | ○ |
| 32 | 59 | ◎ | 10.3 | 12.9 | 2.04 | 8.9 | ○ |
| 33 | 56 | ○ | 11.0 | 9.5 | 2.43 | 10.5 | ○ |
| 34 | 55 | x | 13.8 | 13.2 | 2.03 | 7.9 | ○ |
| 35 | 60 | x | 13.2 | 12.8 | 2.05 | 1.0 | x |
| 36 | 26 | x | 12.6 | 13.0 | 2.16 | 4.2 | ○ |
| 37 | 83 | x | 9.4 | 8.4 | 2.47 | 15.8 | x |
| 38 | 58 | ◎ | 14.0 | 12.8 | 2.04 | 12.4 | ○ |
| 39 | 59 | x | 13.5 | 11.0 | 2.20 | 16.7 | ○ |
| 40 | 64 | ◎ | 10.1 | 12.6 | 2.51 | 1.0 | ○ |
| 41 | 63 | x | 13.8 | 12.7 | 1.96 | 23.4 | ○ |
| 42 | 20 | x | 14.0 | 13.0 | 1.93 | 3.8 | x |
| 43 | 87 | ◎ | 13.5 | 12.6 | 2.32 | 7.2 | ○ |
| 44 | 63 | x | 13.2 | 12.9 | 2.02 | 8.9 | ○ |
| 45 | 63 | x | 13.5 | 12.3 | 2.10 | 12.9 | ○ |
| 46 | 59 | ◎ | 11.0 | 12.0 | 2.32 | 1.3 | x |
| 47 | 60 | x | 10.0 | 11.1 | 2.51 | 19.5 | ○ |
| 48 | 20 | x | 11.2 | 11.5 | 2.26 | 10.7 | ○ |
| 49 | 23 | x | 11.4 | 11.6 | 2.25 | 10.3 | ○ |
| 50 | 19 | x | 10.2 | 11.3 | 2.30 | 11.4 | x |

In Table 2, the amount of the $\gamma$-$Bi_2O_3$ phase in a resistor was represented by a weight percent of the $\gamma$-$Bi_2O_3$ phase content determined by an X-ray diffraction method in the bismuth oxide content in the resistor quantitatively determined by chemical analysis. The life under electrical stress was converted from an Arrhenius' plot. Resistors good for 50 years or more under a voltage applying rate of 85% at 40° C. were represented by the mark ○ and particularly, those good for 100 years or more under a voltage applying rate of 85% at 40° C. were represented by the mark ◎. The lightning current impulse withstand capability was determined as an energy value (passed value) converted from a withstand capability after 2 repetitions of applying, with a 5 minute interval, lightning current impulse with a waveform of 4/10 μs. The switching current impulse withstand capability was determined as an energy value (passed value) converted from a withstand capability after 20 repetitions of applying a switching current impulse with a waveform of 2 ms. The discharge voltage ratio was obtained as a ratio of a varistor voltage ($V_{1mA}$) to a discharge voltage ($V_{30KA}$) when a current of 30 KA with a waveform of 4/10 μs was applied. The change rate of the discharge voltage after applying current impulse was calculated from varistor voltage ($\Delta V_{1mA}$) before and after 10 repetitions of applying a current of 40 KA with a waveform of 4/10 μs. This value represents a decrease rate against an initial value.

With respect to the water penetrating characteristics, a resistor was immersed in a fluorescent flaw detective solution for 24 hours under a pressure of 200 kg/cm$^2$ and then a water penetrating condition was inspected. The mark ○ represents no penetration and the mark x represents penetrations observed.

It is understood from the results shown in Table 2 that Samples Nos. 50–98 containing additives and $\gamma$-$Bi_2O_3$ all in an amount falling within the scope defined by the second embodiment of the present invention are satisfactory in all characteristics, different from Comparative Samples Nos. 26–50 which do not meet some of the requirements of the present invention. Though oxides were used as a starting material in the examples of the present invention, it is natural that the same effect can be obtained by using compounds convertible to oxides during firing, such as carbonates, nitrates, hydroxides or the like. Besides the additives recited in claims, needless to say, other materials also may be incorporated in accordance with a use object of the non-linear resistors.

As it is clearly understood from the above explanation, by limiting the quantities and the kinds of the additive ingredients as well as the quantity of the $\gamma$-$Bi_2O_3$ phase, voltage non-linear resistors excellent in all characteristics, such as life under electrical stress, current impulse withstand capability, discharge voltage ratio, change rate of discharge voltage after application of current impulse and water penetrating characteristics, can be obtained. Furthermore, the resistors of the present invention can be made compact, as its varistor voltage can be improved.

What is claimed is:

1. A voltage non-linear resistor comprising zinc oxide as a principal ingredient and containing additives of:
0.4–1.5 mol. % of bismuth oxides calculated as $Bi_2O_3$,
0.3–1.5 mol. % of cobalt oxides calculated as $Co_2O_3$,
0.2–1.0 mol. % of manganese oxides calculated as $MnO_2$,
0.5–1.5 mol. % of antimony oxides calculated as $Sb_2O_3$,
0.1–1.5 mol. % of chromium oxides calculated as $Cr_2O_3$,
0.4–3.0 mol. % of silicon oxides calculated as $SiO_2$,
0.5–2.5 mol. % of nickel oxides calculated as NiO,
0.001–0.05 mol. % of aluminum oxides calculated as $Al_2O_3$,
0.0001–0.05 mol. % of boron oxides calculated as $B_2O_3$,
0.0001–0.05 mol. % of silver oxides calculated as $Ag_2O$, and
0.0005–0.1 mol. % of zirconium oxides calculated as $ZrO_2$
wherein said bismuth oxides comprise a crystalline phase containing a γ-type crystalline phase in an amount of at least 30% by weight of said bismuth oxides.

2. A voltage non-linear resistor as claimed in claim 1, wherein the contents of the additive ingredients are:
0.6–1.2 mol. % of bismuth oxides calculated as $Bi_2O_3$,
0.5–1.2 mol. % of cobalt oxides calculated as $Co_2O_3$,
0.3–0.7 mol. % of manganese oxides calculated as $MnO_2$,
0.8–1.3 mol. % of antimony oxides calculated as $Sb_2O_3$,
0.3–1.0 mol. % of chromium oxides calculated as $Cr_2O_3$,
0.6–1.9 mol. % of silicon oxides calculated as $SiO_2$,
1.0–1.5 mol. % of nickel oxides calculated as NiO,
0.002–0.03 mol. % of aluminum oxides calculated as $Al_2O_3$,
0.001–0.03 mol. % of boron oxides calculated as $B_2O_3$,
0.001–0.03 mol. % of silver oxides calculated as $Ag_2O$, and
0.001–0.05 mol. % of zirconium oxides calculated as $ZrO_2$, and, the content of said γ-type crystalline phase in the crystalline phase of the bismuth oxides is at least 50% by weight of said bismuth oxides.

3. A voltage non-linear resistor as claimed in claim 1, further comprising sodium oxide, calculated as $Na_2O$, in an amount of 0.001–0.05 mol. %.

4. A voltage non-linear resistor as claimed in claim 3, wherein said sodium oxide, calculated as $Na_2O$ is contained in an amount of 0.005–0.02 mol. %.

5. A voltage non-linear resistor as claimed in claim 1, wherein a content of iron oxides, calculated as $Fe_2O_3$ in the resistor does not exceed 0.05% by weight of the resistor.

6. A voltage non-linear resistor comprising zinc oxide as a principal ingredient and containing additives of:
0.3–1.5 mol. % of bismuth oxides calculated as $Bi_2O_3$,
0.3–1.5 mol. % of cobalt oxides calculated as $Co_2O_3$,
0.2–1.5 mol. % of manganese oxides calculated as $MnO_2$,
0.5–1.5 mol. % of antimony oxides calculated as $Sb_2O_3$,
0.1–1.5 mol. % of chromium oxides calculated as $Cr_2O_3$,
4.0–10.0 mol. % of silicon oxides calculated as $SiO_2$,
0.5–2.5 mol. % of nickel oxides calculated as NiO,
0.001–0.05 mol. % of aluminum oxides calculated as $Al_2O_3$,
0.0001–0.05 mol. % of boron oxides calculated as $B_2O_3$,
0.0001–0.05 mol. % of silver oxides calculated as $Ag_2O$, and
0.0005–0.1 mol. % of zirconium oxides calculated as $ZrO_2$
wherein said bismuth oxides comprise a crystalline phase containing a γ-type crystalline phase in an amount of at least 30% by weight of said bismuth oxides.

7. A voltage non-linear resistor as claimed in claim 1, wherein the contents of the additive ingredients are:
0.5–1.0 mol. % of bismuth oxides calculated as $Bi_2O_3$,
0.5–1.2 mol. % of cobalt oxides calculated as $Co_2O_3$,
0.3–1.0 mol. % of manganese oxides calculated as $MnO_2$,
0.8–1.3 mol. % of antimony oxides calculated as $Sb_2O_3$,
0.3–1.0 mol. % of chromium oxides calculated as $Cr_2O_3$,
6.0–9.0 mol. % of silicon oxides calculated as $SiO_2$,
1.0–1.5 mol. % of nickel oxides calculated as NiO,
0.002–0.02 mol. % of aluminum oxides calculated as $Al_2O_3$,
0.001–0.03 mol. % of boron oxides calculated as $B_2O_3$,
0.001–0.03 mol. % of silver oxides calculated as $Ag_2O$, and
0.001–0.05 mol. % of zirconium oxides calculated as $ZrO_2$,
and, the content of said γ-type crystalline phase in the crystalline phase of the bismuth oxides is at least 50% by weight of said bismuth oxides.

8. A voltage non-linear resistor as claimed in claim 6, further comprising sodium oxide, calculated as $Na_2O$, in an amount of 0.001–0.05 mol. %.

9. A voltage non-linear resistor as claimed in claim 8, wherein said sodium oxide, calculated as $Na_2O$ is contained in an amount of 0.005–0.02 mol. %.

10. A voltage non-linear resistor as claimed in claim 6, wherein a content of iron oxides, calculated as $Fe_2O_3$ in the resistor does not exceed 0.05% by weight of the resistor.

* * * * *